United States Patent [19]

Abe et al.

[11] Patent Number: 4,460,494

[45] Date of Patent: Jul. 17, 1984

[54] RESISTOR

[75] Inventors: Katsuo Abe, Yokosuka; Tsuneyoshi Kawahito, Yokohama; Tsuneaki Kamei, Kanagawa; Masao Mitani, Yokohama; Kazuyuki Fujimoto, Tokyo; Shigetoshi Hiratsuka, Yokohama, all of Japan

[73] Assignee: Hitachi, Ltd., Tokyo, Japan

[21] Appl. No.: 440,419

[22] Filed: Nov. 9, 1982

[30] Foreign Application Priority Data

Nov. 13, 1981 [JP] Japan ..... 56-181150

[51] Int. Cl.[3] ..... H01B 1/02

[52] U.S. Cl. ..... 252/512; 338/20

[58] Field of Search ..... 252/512, 518; 338/20, 338/21; 75/134 R, 134 S

[56] References Cited

U.S. PATENT DOCUMENTS

| | | | |
|---|---|---|---|
| 3,477,935 | 11/1969 | Hall | 75/171 |
| 4,021,277 | 5/1977 | Shirn | 338/308 |
| 4,100,524 | 7/1978 | Kusch | 252/513 |
| 4,204,935 | 5/1980 | Klesse | 252/513 |
| 4,298,505 | 11/1981 | Dorfield et al. | 252/513 |

*Primary Examiner*—Josephine Barr

*Attorney, Agent, or Firm*—Antonelli, Terry & Wands

[57] ABSTRACT

Disclosed is a resistor made of an alloy consisting essentially of Cr, Si and SiO.

3 Claims, 6 Drawing Figures

RESISTOR

BACKGROUND OF THE INVENTION

1. Field of the Invention

The present invention relates to a novel resistor and, more particularly, to a ternary alloy resistor consisting essentially of Cr, Si and SiO.

2. Description of the Prior Art

Resistors in the form of thin film are used in various fields such as circuits and thermal printheads produced by the thin film technic.

Hitherto, the thin film resistors have been produced mainly from Cr-Si alloy and Cr-SiO alloy. These materials, however, suffered from various problems as shown in Table 1 below.

TABLE 1

| Cr—Si resistor (USP-4343986) | Cr—SiO resistor (IBM Technical Disclosure Bulletin Vol. 23 No. 2, July 1980) |
|---|---|
| Changes resistance value when left for long time at high temperature. For instance, 3 to 7% resistance change is caused when resistor is held at 200° C. for 600 hours. | Same disadvantage as Cr—Si resistor when left for long time at high temperature. |
| Maximum power density is as small as 4W/mm$^2$. | Almost same level of maximum power density as Cr—Si resistor. |
| Only positive temperature coefficient is available. | Only negative temperature coefficient is available. |
| — | Etching speed is too low. |

SUMMARY OF THE INVENTION

Accordingly, an object of the invention is to provide a novel resistor having features of:

(1) substantially little change in resistance value even when left for a long time at a high temperature, (2) larger maximum dissipation power density than conventional resistors, (3) wide range of temperature coefficient covering both of moderate negative and positive values and (4) controllability of etching speed; thereby to overcome the above-described drawbacks of the prior art.

To this end, according to the invention, there is provided a resistor made of a Cr-Si-SiO ternary alloy which is formed by adding SiO to Cr and Si or, alternatively, by adding Si to Cr and SiO.

The novel resistor of the invention offers the following advantages (1) to (5).

(1) Stabilization of resistance value by heat treatment is possible.

(2) The change in resistance value due to high temperature is as small as 2% at the maximum when the resistor is left in the air of 450° C.

(3) It is possible to attain a large power density well reaching 20 to 40 W/mm$^2$, so that the resistor can be used also as a heat generating element. When used as a heat generating element, it is possible to simplify the heat sink portion.

(4) The adaptability or uses of the resistor can be increased or widened, because both of positive and negative temperature coefficients are available.

(5) The fabrication of the resistor pattern is facilitated, because it can be etched easily.

The Si, Cr and SiO contents of this novel alloy are preferably selected to meet the following condition which provides a specific resistance ranging between 50 $\mu\Omega$cm and $5\times10^5$ $\mu\Omega$cm:

$$1<Si<98 \text{ mol\%} \quad 1<Cr<98 \text{ mol\%} \quad 1<SiO<98 \text{ mol\%}$$

More preferably, the Si, Cr and SiO contents are selected to meet the following condition which provides a specific resistance ranging between 50 $\mu\Omega$cm and 50000 $\mu\Omega$cm which in turn appreciably facilitates the design of the practical resistors. This condition also ensured substantially little change in the resistance value even when the resistor is held for a long time at a high temperature.

$$4<Si<89 \text{ mol\%} \quad 10<Cr<85 \text{ mol\%} \quad 1<SiO<60 \text{ mol\%}$$

Most preferably, the Si, Cr and SiO contents are selected to meet the following condition, because the following condition can reduce the change in resistance value even when the resistor is held for a long time at a high temperature, i.e. minimizes the deterioration of the resistor, while realizing a high dissipation power density of, for example, 20 to 40 W/mm$^2$ at 300° C.

$$15<Si<79 \text{ mol\%} \quad 20<Cr<74 \text{ mol\%} \quad 1<SiO<55 \text{ mol\%}$$

According to transmission electron microscope images, the resistor of the invention made of Cr-Si-SiO system alloy exhibits intermetallic compounds of Cr-Si such as CrSi and $CrSi_2$ in accordance with the composition ratio between Cr and Si and, in some cases, exibits fine crystalline structure state involved in which the region of the aforesaid intermetallic compounds and the region of amorphous Cr-Si-SiO coexist in a combined or mixed state. The alloys having such intermetallic compounds and the alloys having such fine crystalline structure state are all fall within the scope of the Cr-Si-SiO ternary alloy composition in accordance with the invention.

The resistor of the invention can be produced by ordinary sputtering process using, for example, a DC sputtering device of planar magnetron type or the conventional diode type.

DETAILED DESCRIPTION OF THE PREFERRED EMBODIMENTS

The invention will be described more fully through explanation of preferred embodiments hereinunder.

EXAMPLE 1

First of all, an explanation will be made as to the method of producing the resistor in accordance with the invention.

(Method of Producing Resistor)

A target was placed in a vacuum vessel so as to oppose to a substrate. The target has Si area and Cr area which are determined at a predetermined ratio to each other. For instance, the ratio of the Si area to the Cr area was 80:20. The vacuum vessel of the DC sputtering device was evacuated by a suitable evacuating means to a pressure lower than $5\times10^{-7}$ Torr. Argon gas having a predetermined oxygen content was introduced into the vacuum vessel to form an atomsphere in which argon gas and oxygen gas showed partial pressures of 1 to 10 mTorr and $1\times10^{-7}$ to $1\times10^{-3}$ Torr, respectively. The substrate was rotated as required.

A glow discharge was caused by aplying a negative voltage of 400 V to 10 KV on the target thereby to form a thin film of a Cr-Si-SiO alloy having a predetermined composition. The film thickness ranged between 1000 Å and 3000 Å.

(Identification of Resistor)

An identification of the thus obtained Cr-Si-SiO alloy was conducted in a manner explained below.

First of all, the resistor was subjected to an element analysis by plasma spectrum analysis technic. More specifically, elements were made to illuminate at super high temperatures of 6000° to 8000° C. and qualitatively analyzed by the spectral distribution and quantitatively by the level of the spectrum. The resistor mentioned above proved to consist of 72.0 at% Si and 28.0 at% Cr.

Then, the state of bonding of atoms and the amount of bonding of atoms were examined through an X-ray electronic analysis. More specifically, an X-ray was irradiated to the resistor to excite and free photoelectrons. The state of bonding was observed through the measurement of the chemical shift, i.e. the extent of the shift of spectrum of photoelectron energy from the standard bonding state, while the composition ratio was determined from the ratio of levels of the spectrum.

The following facts (1) and (2) proved as the result of this examination.

(1) The bonding Cr-O can be known from the amount of the chemical shift from the Cr-Cr bonding. Throughout the examination, however, no chemical shift was observed. This means that no oxide of Cr was contained in the alloy.

(2) The presence of Si-O bonding can be known through the detection of the chemical shift from the Si-Si bonding. The existence ratio between Si element and Si oxides was measured to be 95:5 from the ratio of spectrum intensity obtained in the plasma spectrum analysis.

The composition ratio Cr:Si:SiO proved to be 28:65:7 as result of the measurement.

Figure 1A:
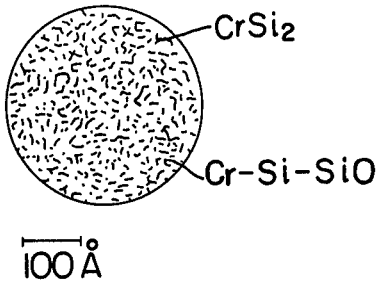
FIGS. 1*a*, 1*b* and 1*c* are sketches of transmission electron microscope images of a resistor in accordance with the invention.

According to transmission electron microscope photograph, as shown in FIG. 1*a*, the presences of crystalline $CrSi_2$ region and amorphous Cr-Si-SiO region were proved. The degree of crystallization was rather small.

EXAMPLE 2

Figure 1B:
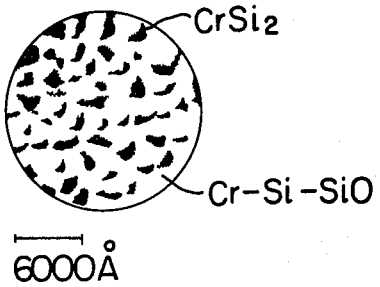
Figure 1C:
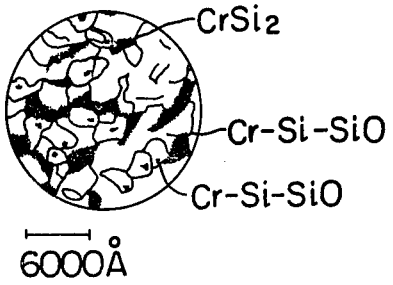

A resistor was formed on a substrate by a DC sputtering device as indicated at No. 2 in Table 2. Also, a resistor was formed on a substrate by a DC sputtering device of planar magnetron type as indicated at No. 3 in Table 2. These resistors were identified substantially in the same manner as Example 1. As a result of the identification, values appearing in No. 2 and No. 3 in Table 2 were obtained, as well as transmission electron microscope images shown in FIGS. 1*b* and 1*c*. The image shown in FIG. 1*b* exhibits greater degree of crystallization than that in FIG. 1*a*. The degree of crystallization in the image shown in FIG. 1*c* was further increased as compared with that in FIG. 1*b*.

EXAMPLE 3

Measurement was conducted with the resistors produced by the methods in Examples 1 and 2 for the following factors: (1) specific resistance, (2) temperature coefficient of resistance, (3) hardness, (4) tensile stress, (5) density and (6) etching characteristics, and the values shown in No. 1 and No. 3 in columns in Table 2 were obtained.

EXAMPLE 4

Figure 2:
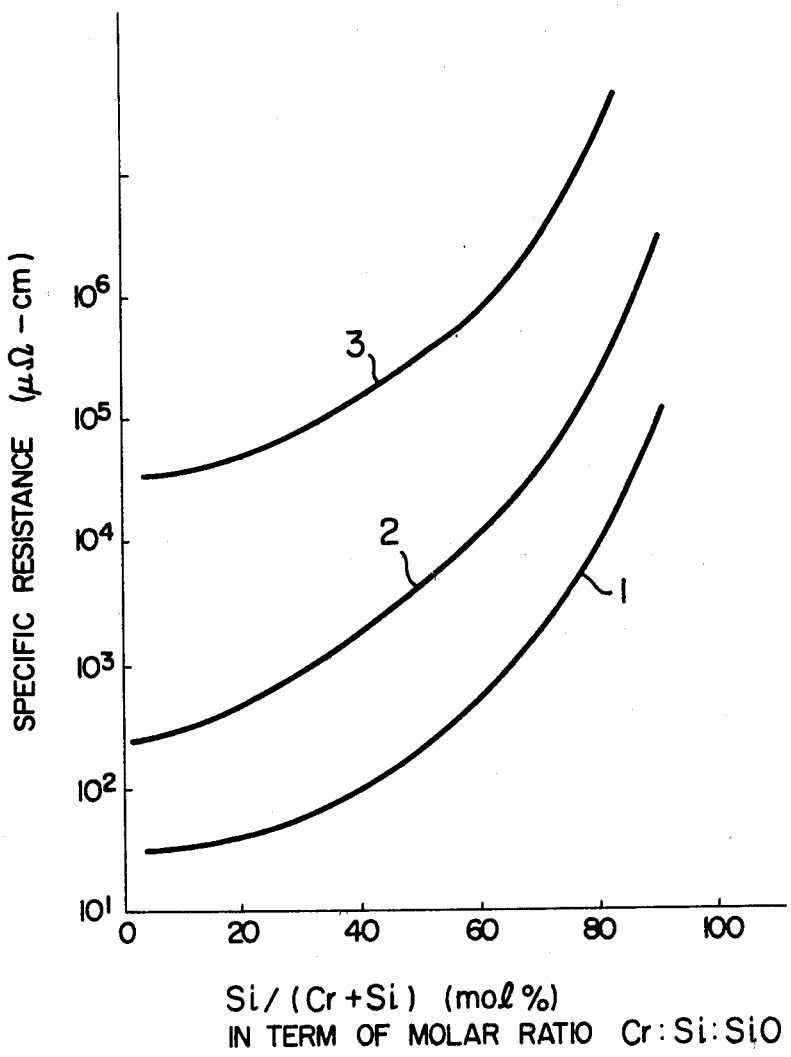
FIGS. 2 to 6 show various characteristics of the resistor in accordance with the invention.

An experiment was conducted to examine how the specific resistance was changed by a change in the ratio between Si and Cr in ternary alloys consisting of SiO, Cr and Si, and having SiO content of 8 mol%, 37 mol% and 64 mol%, respectively, and the result of which experiment is shown at 1 to 3 in FIG. 2.

Figure 3:
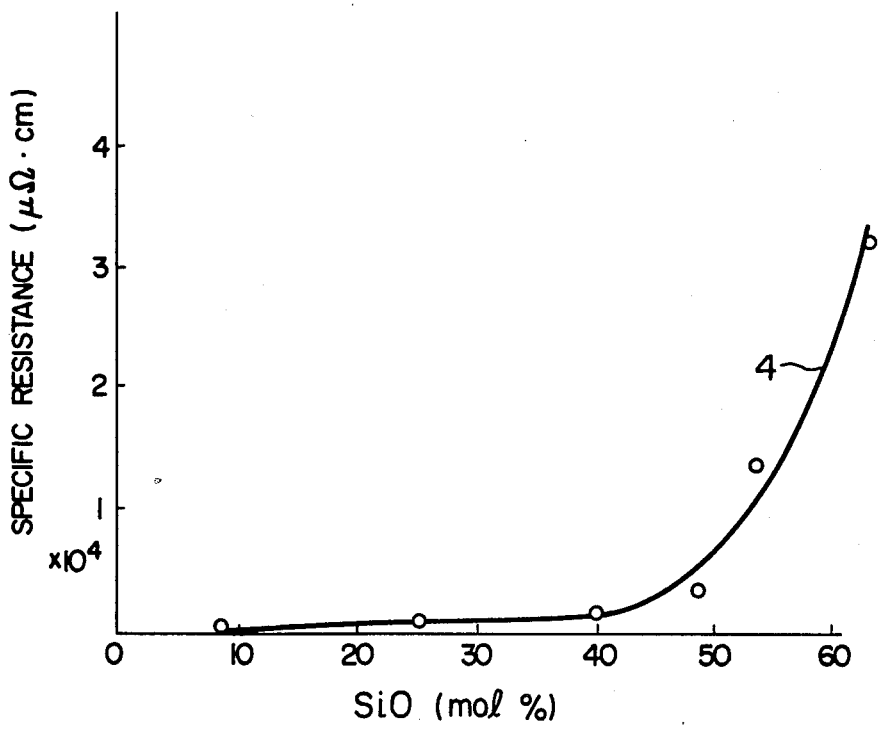

Specific resistances obtained with the various ratio between (Cr+Si) and SiO content in the alloy under the presence of 36 mol%.of Cr/(Si+SiO+Cr) are shown as curve 4 in FIG. 3.

TABLE 2

| items | No. 1 | No. 2 | No. 3 |
|---|---|---|---|
| identification results | | | |
| Si:Cr | 72.0:28.0 | 63.8:36.2 | 66.0:34.0 |
| Cr element: Cr oxide | 100:0 | 100:0 | 100:0 |
| Si element: Si oxide | 95:5 | 71:29 | 91:9 |
| Cr:Si:SiO | 28:65:7 | 56:27:37 | 34:54:12 |
| characteristics | | | |
| specific resistance (μΩcm) | 1010 | 2130 | 2830 |
| resistor's temperature (ppm) coefficient | −310 | 90 | 500 |
| hardness (Hv:kg/mm²) | 1030 | 670 | 1230 |
| tensile stress (Kg/mm²) | −20 | −36 | 123 |
| density (g/cm³) | 3.6 | 3.4 | 4.05 |
| etching controllability | | good | |
| remarks | | | |
| sputtering device | DC sputtering device | DC sputtering device | planar magnetron type DC sputtering device |
| target area ratio | | Si:Cr = 80:20 | |

EXAMPLE 5

A Cr-Si-SiO ternary alloy consisting of Cr 33 mol%, Si 66 mol% and SiO 1 mol% exhibited a temperature coefficient of +2500 ppm at temperature between 18° C. and 300° C. In contrast, a Cr-Si-SiO ternary alloy consisting of Cr 10 mol%, Si 40 mol% and SiO 50 mol% showed a temperature coefficient of −10000 ppm at temperature between 18° C. and 300° C. Also, a Cr-Si-SiO ternary alloy consisting of Cr 20 to 50 mol%, Si 15 to 55 mol% and SiO 25 to 50 mol% showed a temperature coefficient of ±100 ppm in temperature range between 18° C. and 300° C.

EXAMPLE 6

Figure 4:
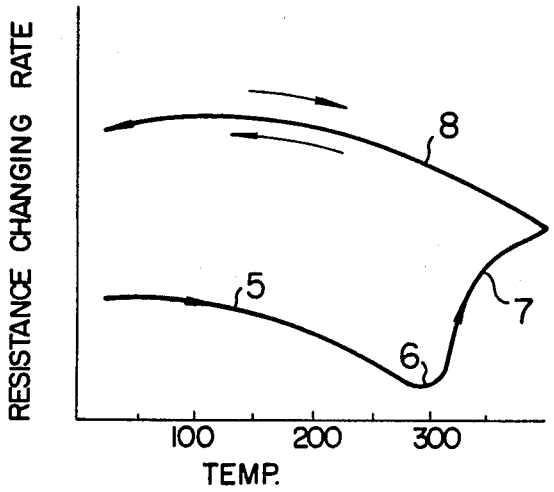

FIG. 4 shows the transient state of change in resistance value caused by heat treatment (temperature gradient 2° C./min) in the Cr-Si-SiO ternary alloy. From FIG. 4, it will be seen that there is the region 5 in which the resistance value is decreased as the temperature is raised. The region 5 is connected irreversibly through the point of minimum value 6 to a region 7 in which the resistance value is irreversibly increased in accordance with the rise in the temperature. The region 7 in trun is connected to a region in which the resistance value is reversibly changed as the temperature is raised and lowered. The minimum value at the point 6 varies depending on the composition ratio of Cr-Si-SiO, method of formation of the film and the temperature at which the film is formed. The gradient in the region 8 corresponds to the temperature coefficient itself which is determined by the composition ratio Cr-Si-SiO, the degree of crystallization, and the temperature at which the film is formed, while the specific resistance is determined by the composition ratio of Cr-Si-SiO and the temperature of the heat treatment, but is not finally affected by the temperature at which the film is formed. Therefore, it is indispensable to effect the heat treatment at a temperature higher than the temperature at which the minimum value 6 is obtained, in order to stablize the resistance value. In some cases, however, the resistance value can be stabilized without any heat treatment, provided that the temperature at which the minimum value is obtained, is sufficiently attained during the formation of the film.

Figure 5:
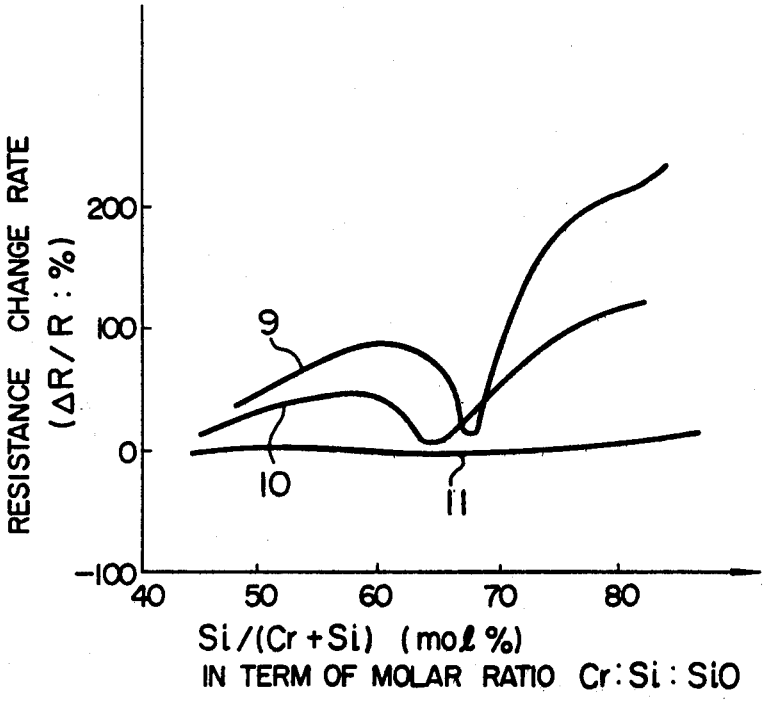

In FIG. 5, curves 9, 10 and 11 show the rates of change in the resistance when Cr-Si-SiO ternary alloys having $SiO_2$ contents of 1 mol%, 7 mol% and 37 mol%, respectively, with various ratios between Si and Cr contents are heat-treated at 400° C. It will be seen that the alloy having SiO content of 37 mol% does not exhibit substantial change in the resistance value even when the ratio between Si and Cr contents is varied.

It is considered that the change in the resistance value by the heat treatment is attributable to a change in the fine crystalline structure, as well as a change in the oxygen in the amorphous state, i.e. oxygen is not contributing to the crystallization.

EXAMPLE 7

Figure 6:
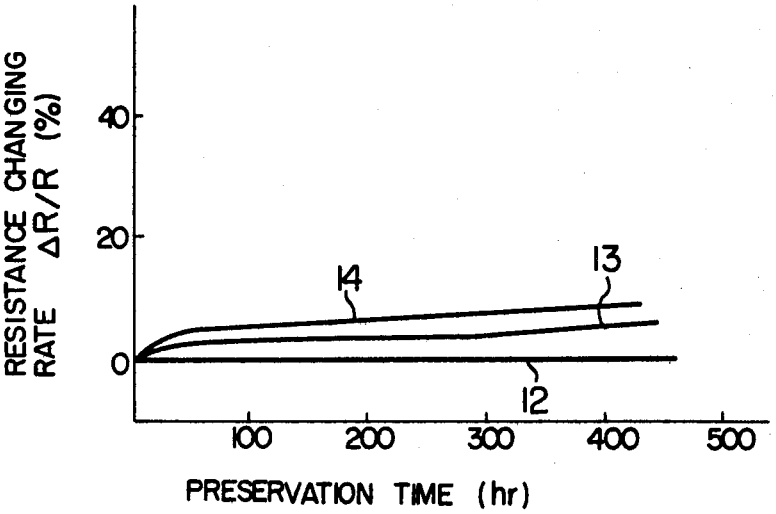

Curves 12, 13 and 14 in FIG. 6 show the resistance changing ratios of a Cr-Si-SiO (36:27:37) ternary alloy, a Cr-SiO alloy and a Cr-Si alloy as observed when these alloys are left for a long time in the air of 450° C. It will be seen that the novel Cr-Si-SiO system resistor in accordance with the invention exhibits a high oxidation resistance, as well as stable resistance value.

This result suggests also that the material of the resistor in accordance with the invention enables an operation at higher density of dissipation power than other materials. Table 3 shows the manner of secular change in the resistance value, as well as how the dissipation power density is changed by the composition ratio of Cr-Si-SiO.

TABLE 3

| Cr:Si:SiO (mol %) | secular change in resistance value (250° C. × 600 hr) | electric power density (at 300° C.) |
|---|---|---|
| 28:65: 7 | 0.9% | 34 W/mm$^2$ |
| 36:27:37 | 0.6 | 40 |
| 34:54:12 | 0.3 | 28 |
| 58:13:29 | 0.7 | 25 |
| 22:18:60 | 1.3 | 17 |
| 50:10:40 | 1.4 | 16 |
| 68:24: 8 | 1.9 | 11 |
| 12:58:30 | 1.8 | 12 |

EXAMPLE 8

When a nitrate type etchant is used, the adequate etching speed for fine processing of the thin film made of the Cr-Si-SiO ternary alloy in accordance with the invention falls within a moderate range of between 50 Å/min and 200 Å/min advantageously. In contrast, the Cr-SiO system alloy requires an etching speed of 5 to 50 Å/min which is too low, while the Cr-Si system alloy exhibits a too high etching speed.

The resistor in accordance with the invention offers various advantages over the conventional resistors, and can stand a long use with a sufficient stability of resistance value even under the circumstance of high temperature. The resistor of the invention, therefore, can find various diversifying uses such as thermal printhead.

What is claimed is:

1. A resistor made of an alloy consisting essentially of 1 to 98 mol% of Cr, 1 to 98 mol% of Si and 1 to 98 mol% of SiO.

2. A resistor made of an alloy consisting essentially of 10 to 85 mol% of Cr, 4 to 89 mol% of Si and 1 to 60 mol% of SiO.

3. A resistor made of an alloy consisting essentially of 20 to 74 mol% of Cr, 15 to 79 mol% of Si and 1 to 55 mol% of SiO.

* * * * *